US006032873A

United States Patent [19]

Weinstein

[11] Patent Number: 6,032,873

[45] **Date of Patent: *Mar. 7, 2000**

[54] LIQUID DRINKING ASSEMBLAGE

[76] Inventor: Robert E. Weinstein, 177 Commonwealth Ave., Boston, Mass. 02116

[ * ] Notice: This patent is subject to a terminal disclaimer.

[21] Appl. No.: 09/178,753

[22] Filed: Oct. 26, 1998

[51] Int. Cl.[7] ..... A47G 21/18; B05B 12/14

[52] U.S. Cl. ..... 239/33; 239/24; 239/29

[58] Field of Search ..... 239/24, 29, 33

[56] References Cited

U.S. PATENT DOCUMENTS

| | | | |
|---|---|---|---|
| D. 336,043 | 6/1993 | Provencio . | |
| 2,052,307 | 8/1936 | Kennedy . | |
| 2,531,855 | 11/1950 | Loptson . | |
| 3,773,256 | 11/1973 | Wright | 239/33 X |
| 4,699,318 | 10/1987 | Donatello et al. | 239/33 |
| 5,725,018 | 3/1998 | Paczonay | 239/33 X |
| 5,806,765 | 9/1998 | Weinstein | 239/33 |

FOREIGN PATENT DOCUMENTS

| | | | |
|---|---|---|---|
| 4305589 | 4/1994 | Germany | 239/33 |
| 94/14400 | 7/1994 | WIPO | 239/33 |

*Primary Examiner*—Andres Kashnikow
*Assistant Examiner*—Robin O. Evans
*Attorney, Agent, or Firm*—Morse & Altman

[57] ABSTRACT

An assemblage for drinking a plurality of potable and/or medicinal liquids simultaneously from discrete receptacles while prevent contamination of one liquid by another. The assemblage comprises a plurality of conduits joined together that convey isolated streams of the liquids from separate receptacles into the mouth. Preferably, the conduits are mechanically deformable along their axes of elongation. The conduits are joined by a catch, by binding, by molding the conduits as a single unit, or by raveling. At least one conduit includes a check valve.

2 Claims, 3 Drawing Sheets

LIQUID DRINKING ASSEMBLAGE

BACKGROUND OF THE INVENTION

1. Field of the Invention

The present invention relates to dispensers for potable liquids, more specifically, to apparatus for conveying more than one liquid into the mouth discretely and simultaneously.

2. The Prior Art

When eating solid foods, it is common to simultaneously place more than one food into the mouth, i.e. meat and potato on a fork. This practice allows the eater to combine foods to satisfy his or her personal tastes. By virtue of the integrity of solid food, it is also possible for the eater to place additional food in the mouth before swallowing. An example might be having meat in the mouth, then taking a bite of bread, chewing and swallowing both. This allows the eater to spontaneously combine foods in the mouth to suit his or her tastes.

In contrast to solid foods, it is difficult to take in a second beverage while one is already in the mouth. A person takes drink by either lifting the drink container to the mouth or by using a straw to draw the beverage into the mouth. In the former case, it is extremely difficult to take a second drink before swallowing the first mouthful—when the mouth is opened to take the second drink, the beverage already in the mouth will spill out. And in the latter case, it is very awkward to try to put the straw back into the mouth before swallowing the first mouthful. Either the straw must be pushed between clenched lips or the head must be tilted backwards to keep the beverage from spilling out.

One solution is to use two straws. There are several disadvantages to this. First, one must find two straws that are appropriate relative to each other. They may not have the necessary diameters or lengths. In addition, because the straws are not joined together, it is awkward to keep them fixed relative to each other, should it be desired.

Another solution is disclosed in U.S. Pat. No. 3,260,462, issued to Smaczny. Smaczny discloses a forked drinking straw, where there are two legs and a central tube. Each leg is inserted into a different container and the liquids are mixed either in the central tube or in a mixing chamber located at the junction of the legs and central tube prior to reaching the mouth. There are situations where mixing the liquids before reaching the mouth is not desirable. An example of such a case is when the combination creates an effervescent beverage, where, because of gas pressures, it would be dangerous to create the beverage in the confined space of a straw. Another example is when it is desired to taste the flavor of the different liquids separately and then combined.

Taste buds of a single type are grouped together and located in particular areas of the mouth. It is occasionally desirable to direct different components of a beverage to different locations in the mouth to take advantage of the location of particular types of taste buds. The Smaczny device will not work for this purpose because the beverage components are mixed prior to reaching the mouth. It is possible to use two separate straws for this purpose, but it is very awkward to hold the straws in fixed position relative to each other and relative to locations in the mouth and containers.

Thus, there is a continuing need for a device that can be used by a person to drink more than one liquid simultaneously such that the liquids are combined in the mouth and that can direct different liquids to different locations in the mouth simultaneously.

SUMMARY OF THE INVENTION

An object of the present invention is to provide an assemblage that allows a person to ingest liquids from several receptacles simultaneously while preventing liquid from one receptacle from entering any other receptacles.

The drinking assemblage consists of a plurality of conduits joined so as to direct isolated streams of the liquids from receptacles into the mouth. Each conduit is composed of a material rigid enough so that the conduit will not bend over from the force of gravity when standing on end. A plastic will provide the assemblage with a long useful life and a coated paper will provide the assemblage with a low manufacturing cost.

Typically, the conduits will have the same length. The length of one or more may be shortened in order to customize the assemblage for a particular use. The cross-sectional shape may be formed into any desired shape, but is typically round. The cross-sectional area of the conduits are typically the same, but can be formed to regulate the amount of each liquid reaching the mouth at the same time or to accommodate liquids of differing densities. Optionally, the cross-sectional area can be controlled dynamically by pinching the conduit walls. In this way, the proportion of liquids reaching the mouth can be changed dynamically to accommodate the tastes of the drinker.

The conduit may be longitudinally rigid or mechanically deformable by applying force. In the rigid embodiment, the conduit will maintain its longitudinal shape under a moderate amount of stress. In one deformable embodiment, the conduit does not maintain the deformed shape after the force is removed. In another deformable embodiment, the deformed shape is maintained.

The conduits are joined together while maintaining the isolation of the liquids prior to reaching the mouth. Preferably, the joint is robust enough so that the conduits remain joined together under a modest amount of stress. The joint can be anywhere along the length of the conduits The conduits are joined by either joining already existing conduits together or by forming the conduits as a single unit.

One or more of the conduits include a check valve to prevent liquid from the mouth to enter another receptacle.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
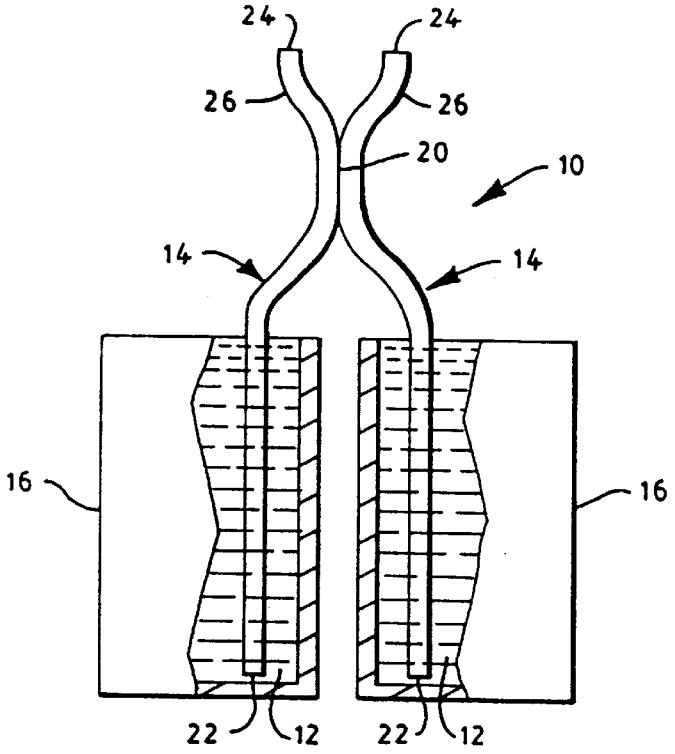
FIG. 1 is a side, cutaway view of the first embodiment of the present invention.

The drinking assemblage 10 of the present invention consists of a plurality of conduits 14 joined together. The conduits 14 conduct isolated streams of potable and/or medicinal liquids 12 from a plurality of isolated receptacles 15 into the mouth, where the liquids 12 combine in the desired manner.

The receptacle configuration and the intended use of the assemblage determines the various parameters of the assemblage 10, including the material of which it is composed, the number of conduits 14, the length of the conduits 14, and the radial cross-sectional shape and area of the conduits 14.

The conduit 14 is preferably composed of a material that is somewhat flexible. The use to which the assemblage 10 will be put determines the material from which the conduit 14 it is made. A semi-rigid plastic, such as polyethylene or polypropylene, will provide the assemblage 10 with a long useful life and the ability to withstand the high temperatures needed to cleanse and disinfect the assemblage 10 for future use.

A coated paper will provide the assemblage 10 with a short life, typically for one use only, but is less expensive to manufacture than a plastic assemblage. The coating prohibits the liquid from soaking into the paper and is preferably a wax or plastic.

Typically, the conduits 14 will have the same length, the length being defined as the linear distance between the ingress 22 and egress 24 of the conduit 14. If the receptacles 16 have different depths, the conduit lengths may be different. In addition, any of the conduits 14 may be shortened in order to customize the assemblage 10 for a particular use.

The preferred cross-sectional shape of each conduit 14 is round. However, any shape may be used, such as semicircular, square or octagonal and different conduits 14 of the same assemblage 10 may have different shapes. The selection of the appropriate cross-sectional shape for a given application depends upon a number criteria, including the use being made of the assemblage 10, the number of conduits 14 attached together to form the assemblage 10, how the conduits 14 are joined together, and the market at which the assemblage 10 is targeted.

Different conduits 14 of the same assemblage 10 may have different cross-sectional areas, which can be used to regulate the relative amounts of the liquids 12 reaching the mouth at the same time. The cross-sectional area determines the flow of liquid 12 through the conduit 14 for a given amount of force. A smaller cross-section will provide less liquid 12 than a larger cross-section with the same amount of force.

Another factor in determining the cross-sectional area of each conduit 14 is the density of the liquids 12 with which the assemblage 10 will be used. For example, a conduit 14 for use with water does not have to be as large as a conduit 14 used for a syrup in order to convey the same amount of each, because a syrup is thicker than water.

Optionally, the cross-sectional area can be controlled by squeezing and releasing the walls 26 of the conduit 14. In one embodiment, the cross-section will substantially maintain its shape after the squeezing pressure is released. In another embodiment, the cross-section of a plastic conduit 14 will return substantially to its original shape when released. This later ability allows the drinker to dynamically regulate the flow of liquid 12 in the conduit 14 by squeezing and releasing the conduit wall 26 with the fingers. In this way, different amounts of the liquids 12 can be mixed, dynamically changing the flavor of the liquid combination to suit the drinker.

Optionally, the conduit 14 is mechanically deformable by applying force so that the linear shape can be adjusted for a particular use. In one embodiment, the conduit 14 does not maintain the deformed shape after the force is removed. In another embodiment, the deformed shape is maintained.

The assemblage 10 is a combination of two or more conduits 14 that are joined together while maintaining the isolation of the streams of liquids 12. The contact area 20 should be robust enough so that the conduits 14 remain joined together under a modest amount of stress.

The conduits 14 may be joined together in any orientation. At one extreme, the longitudinal axes of the conduits 14 are parallel at the contact area 20, as in FIG. 1. At the other extreme, the axes at the contact area 20 are perpendicular, as in FIG. 10.

The location of the contact area 20 is also determined by the intended use of the assemblage 10. If the liquids 12 are to be combined immediately upon entry into the mouth, the contact area 20 can be adjacent to the egresses 24. For other uses, the contact area 20 can be away from the egresses 24, as in FIG. 1.

Figure 2:
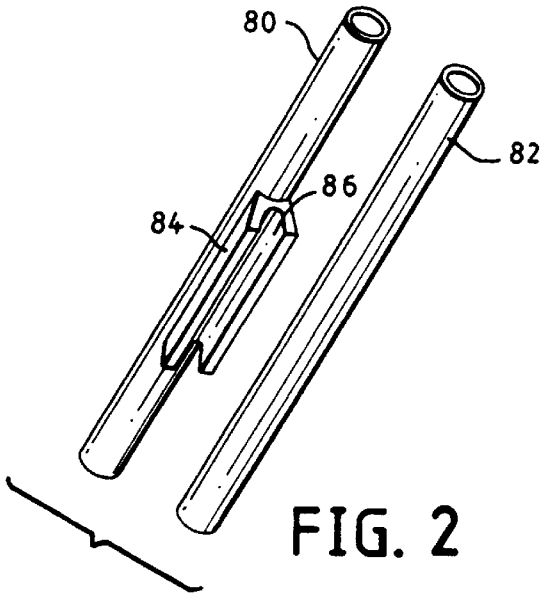
FIG. 2 is an perspective view of one embodiment of the joining of two conduits by interlocking.

In the drinking assemblage 10, the conduits 14 are joined in at least one of a number of ways. The first is to join the conduits 14 together by catches after being individually formed. For example, as shown in FIG. 2, one conduit 80 helps a longitudinal protrusion 84 with a longitudinal cylindrical depression 86. The depression 86 is sized to snap around the circumference of another conduit 82 and to maintain a junction with the other conduit 82 under a modest amount of pressure. The conduits 80, 82 may be separated by pulling them apart to overcome the snap action of the depression 86.

Figure 3:
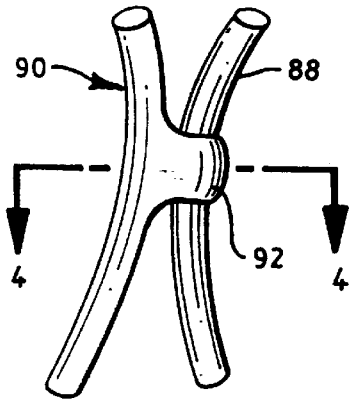
FIG. 3 is an perspective view of a second embodiment of the joining of two conduits by interlocking.
Figure 4:
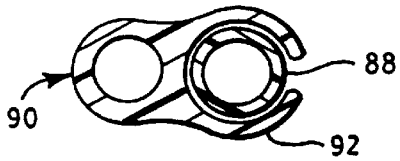
FIG. 4 is a cross-sectional view of FIG. 3 along the line 4—4.

In a first alternative, shown in FIGS. 3 and 4, one conduit 90 is molded around an already existing conduit 88. An already existing first conduit 88 is placed into the mold for forming a second conduit 90. The mold is shaped so that an element 92 of the second conduit 90 encompasses a portion of the first conduit 88. Whether or not the conduits 88, 90 can be separated after molding depends on how much of the circumference of the first conduit 88 is encompassed and on how flexible the second conduit material is.

Figure 5:
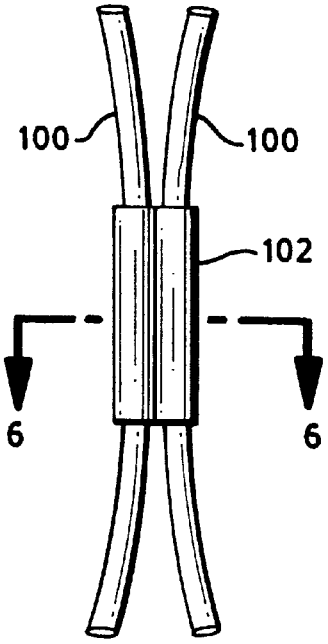
FIG. 5 is a side view of a configuration of the joining of two conduits by interlocking.
Figure 6:
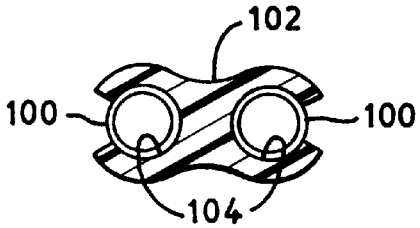
FIG. 6 is a cross-sectional view of FIG. 5 along the line 6—6.

In a second alternative, shown in FIGS. 5 and 6, the two conduits 100 are joined by a joining structure 102 that includes opposed longitudinal cylindrical depressions 104. Each depression 104 is sized to snap around the circumference of a conduit 100 and to maintain a junction with the conduit 100 under a modest amount of pressure. Each conduit 100 may be separated from the joining structure 104 by pulling it from the joining structure 102 to overcome the snap action of the depression 104. Alternatively, the joining structure 102 may be designed so that, once the conduit 100 is snapped into the depression 104, the conduit 100 cannot be separated from the joining structure 102.

Figure 7:
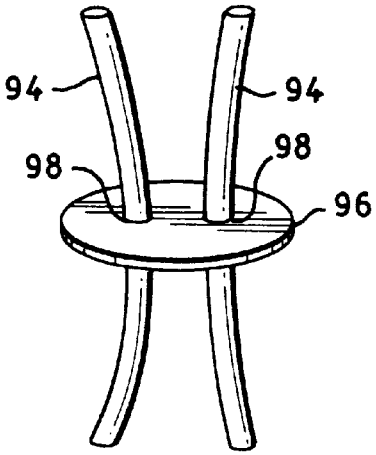
FIG. 7 is a perspective view of another configuration of the joining of two conduits by interlocking.

In a third alternative, shown in FIG. 7, the two conduits 94 are joined by a planar joining structure 96 that includes a pair of apertures 98 in close proximity to each other. Each aperture 98 is sized to hold a conduit 94 that has been pushed into it. Each conduit 94 may be separated from the joining structure 96 by pulling it from the aperture 98. Alternatively, the joining structure 96 may be designed so that, once the conduit 94 is pushed into the aperture 98, the conduit 94 cannot be pulled from the aperture 98.

The second method is to cement or weld the conduits 14 together after being individually formed. Cementing can be used with both plastic and coated paper conduits 14. If the conduits 14 are composed of plastic, they may be welded together such as by applying heat at the contact area 20 and "melting" the conduits 14 together. There are several advantages offered by joining the conduits 14 after they are formed. These include the ability to create small lots of specialized assemblages 10 and the ability to create shapes that cannot use created by molds.

In the third method, the assemblage 10 is formed as a single unit, where the conduits 14 are already joined together. Depending upon where along the conduits 14 they are joined, this may be a more practical approach than forming the conduits 14 and joining them later. The conduits 14 are preferably formed in a mold. Different molds can be made to create assemblages 10 with a varying numbers of conduits 14 joined at different locations along their outside surfaces 26. In this way, special configurations of the conduits 14 can be made. Molding will work easily only with plastic conduits 10; it is not practical for use with coated paper.

Figure 8:
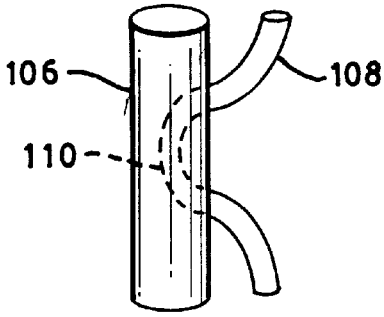
FIG. 8 is a perspective phantom view of an embodiment of the joining of two conduits by molding.

In one embodiment of this method, the conduits are joined at their outer surface, as shown in FIG. 1. Alternatively, the conduits are joined in an overlapping manner, as shown in FIG. 8 where a portion 110 of one conduit 108 is inside the other conduit 106.

Figure 9:
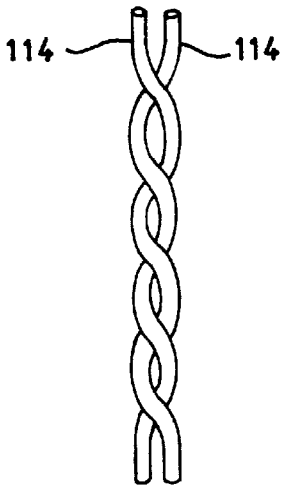
FIG. 9 is a side view of an embodiment of the joining of two conduits by raveling.
Figure 10:
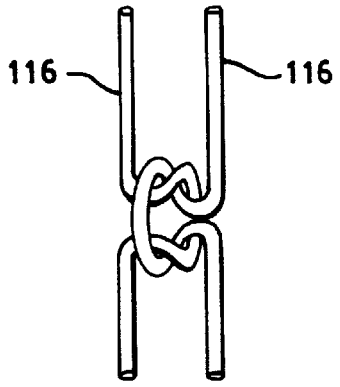
FIG. 10 is a side view of a second embodiment of the joining of two conduits by raveling.

In the fourth method, shown in FIGS. 9 and 10, the two conduits are formed independently and raveled about each other to form a junction. In some cases, like that of FIG. 9, the conduit 114 can be formed into their final shape and then twisted together. In other cases, like that of FIG. 10, the conduits 116 are softened so that they can be bent, twisted or knotted together, and allowed to cool.

The present invention also contemplates that any combination of the above-described joining methods may be used simultaneously.

One or more of the conduits includes a check or one-way valve to prevent liquid from one receptacle from entering another receptacle. This may be useful when, for example, two inert liquids are designed to effervesce when mixed in the mouth, and it would be undesirable for them to mix in either receptacle. While the ideal is that the check valve prevent all of each liquid from entering the other receptacles, the present invention recognizes that this may not be practical if the product is to be made inexpensively. Consequently, the present invention also contemplates that the check valve can prevent most of each liquid from entering the other receptacles, while letting insignificant amounts through.

Figure 11:
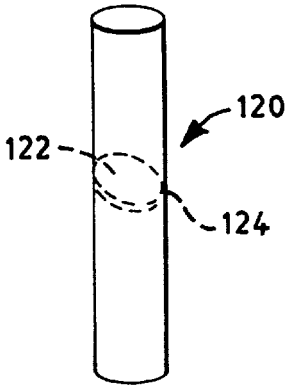
FIG. 11 is a perspective phantom view of a check valve.
Figure 12:
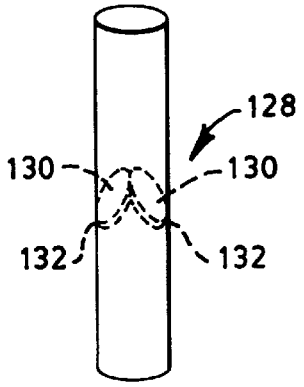
FIG. 12 is a perspective phantom view of a second check valve.
Figure 13:
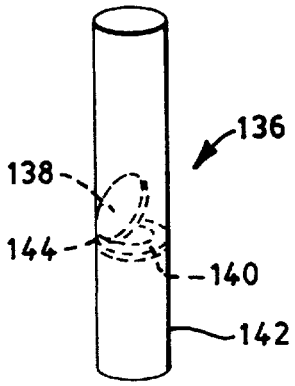
FIG. 13 is a perspective phantom view of a third check valve.
Figure 14:
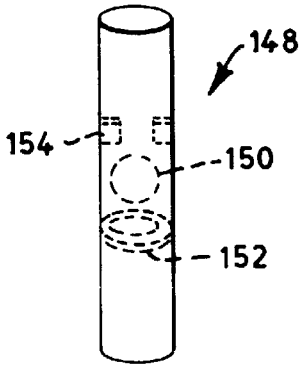
FIG. 14 is a perspective phantom view of a fourth check valve.

Any type of check valve that will operate within the conduit is contemplated by the present invention. Four valve designs are shown in FIGS. 11–14. In all check valve designs, the normal position of the valve is closed, either by a spring force or directly or indirectly by gravity. Pressure from liquid being sucked up the conduit pushes the valve open against the spring force or gravity. As the pressure abates, the spring force, direct gravity, or indirect gravity from the weight of the liquid remaining in the conduit returns the valve to its closed position. FIG. 11 shows a check valve 120 with a single simple flap 122. If the hinge 124 is stiff enough, it can act as a spring to hold the flat 122 closed. FIG. 12 shows a check valve 128 with dual simple flaps 130. Like the previous valve, if the flap hinges 132 are stiff enough, they can act as springs to hold the flaps 130 closed. FIG. 13 shows a check valve 136 with a flap 138 and an annular seat 140 inside the conduit 142 with which the flap 138 forms a seal with the seat 140. Again, the hinge 144 can be designed as a spring. FIG. 14 shows a check valve 148 with a ball 150 and seat 152. The ball 150 moves between the seat 152 and a stop 154. Gravity keeps the ball 150 against the seat 152 when there is no pressure from liquid.

Thus it has been shown and described a drinking assemblage which satisfies the objects set forth above.

Since certain changes may be made in the present disclosure without departing from the scope of the present invention, it is intended that all matter described in the foregoing specification or shown in the accompanying drawings, be interpreted in an illustrative and not in a limiting senses.

What is claimed is:

1. A drinking assemblage for enabling a person to ingest streams of potable or medicinal liquids simultaneously from a plurality of receptacles into a plurality of oral locations, said drinking assemblage comprising:

(a) a plurality of conduits, each having an ingress and an egress;

(b) each of said conduits being joined to at least one other of said conduits at a junction that lies between said ingress and said egress;

(c) said ingresses being adapted for communication respectively with said liquids within said plurality of receptacles;

(d) said egresses being adapted for communication respectively with said plurality of oral locations;

(e) said liquids being isolated from each other when in said conduits; and (f) at least one of said conduits including a check valve to substantially prevent said liquid from flowing from said egress to said ingress.

2. The assemblage of claim 1 wherein said junction is located such that said egress is free to be separated from all other of said egresses to direct said liquids to said plurality of oral locations.

* * * * *